US005801949A

United States Patent [19]

Raasch et al.

[11] Patent Number: 5,801,949

[45] Date of Patent: Sep. 1, 1998

[54] TEXTILE MACHINE WITH A CENTRAL CONTROL DEVICE AND LOCAL CONTROL DEVICES AT THE WORK STATIONS

[75] Inventors: Hans Raasch, Mönchengladbach; Johan Remmerie, Kortrijk; Gerhard Rienas, Heinsberg, all of Germany

[73] Assignee: W. Schlafhorst AG & Co., Monchengladbach, Germany

[21] Appl. No.: 597,827

[22] Filed: Feb. 7, 1996

[30] Foreign Application Priority Data

Feb. 15, 1995 [DE] Germany ..... 195 05 023.1

[51] Int. Cl.[6] ..... G06F 19/00; G06G 7/64; G06G 7/66

[52] U.S. Cl. ..... 364/470; 57/264

[58] Field of Search ..... 364/470; 66/75.2; 57/264; 55/324

[56] References Cited

U.S. PATENT DOCUMENTS

| | | | |
|---|---|---|---|
| 4,192,129 | 3/1980 | Stahlecker | 57/301 |
| 4,475,331 | 10/1984 | Promoli et al. | 57/263 |
| 4,649,720 | 3/1987 | Hellwig et al. | 66/75.2 |
| 4,840,022 | 6/1989 | Karl et al. | 57/263 |
| 5,336,285 | 8/1994 | Grandek et al. | 55/324 |
| 5,386,684 | 2/1995 | Simon et al. | 57/264 |
| 5,469,696 | 11/1995 | Gerhard | 57/264 |

FOREIGN PATENT DOCUMENTS

| | | |
|---|---|---|
| 36 43 300 A1 | 6/1988 | Germany . |
| 38 01 965 A1 | 7/1989 | Germany . |
| 38 41 464 A1 | 6/1990 | Germany . |
| 39 28 831 A1 | 3/1991 | Germany . |
| 40 30 100 A1 | 4/1992 | Germany . |
| 42 21 504 A1 | 1/1993 | Germany . |
| 43 13 523 A1 | 10/1994 | Germany . |

*Primary Examiner*—Reba I. Elmore
*Assistant Examiner*—Monica Lewis
*Attorney, Agent, or Firm*—Kennedy Covington Lobdell & Hickman LLP

[57] ABSTRACT

As an alternative to an expensive bus system commonly utilized in multi-station automatically operating textile machines for exchange of data between a central control device and local control devices at the individual work stations, the present invention provides a central control device disposed on a traveling service unit which can be positioned sequentially at each work station, particularly in the course of a restart of the textile machine, for transmitting data between the central control device and the individual control device of each work station, e.g., for supplying control data to the work stations, for collecting event data, production data and yarn quality data from the work stations, and for assimilating the collected data when the service unit is positioned in front of a work station.

7 Claims, 2 Drawing Sheets

TEXTILE MACHINE WITH A CENTRAL CONTROL DEVICE AND LOCAL CONTROL DEVICES AT THE WORK STATIONS

FIELD OF THE INVENTION

The present invention relates to a textile machine, especially textile yarn handling machines, having a plurality of identical work stations with a traveling service device which can be moved along the work stations and, more particularly, to a work station control and information system for such machines utilizing a central control device with an input device for data relating to the work stations, yarn batches or yarn quality, and a plurality of local control devices each of which is disposed at a respective work station and is connectable with the central control device for data exchange.

BACKGROUND OF THE INVENTION

Present-day textile machines operate fully automatically by utilizing control devices equipped with highly efficient computers or microprocessors. Typically, the data required for controlling a textile machine is input in a central control device at the textile machine. The work stations respectively include individual control devices equipped with individual computers, microprocessors, or other controllers which, to a large extent, control the work flow at the work stations automatically. The respective work station computers are provided with the data necessary for their required operations by the central control device. Particularly following a restart of the machine such as occurs for example after a batch change, it is also possible to transmit to the individual work stations complete programs for the control of each work station as well as for its yarn quality monitor, i.e., the so-called cleaner, which had been read at the central control device. For controlling the individual work stations, the central control device can also interrogate each work station regarding event data, production data and yarn quality data, and in turn assimilate or compile the data according to a predetermined program, protocol or format.

It is known from German Patent Publication DE 39 28 831 Al how the data exchange between the control devices at the work stations of a textile machine and their associated central control device can be performed and what type of infrastructure has been provided for this data exchange operation. In the known textile machine, the control device of each work station is a computer or other processor which is connected via a data bus with the computer of the central control device of the textile machine. In this case, the yarn quality monitor is connected to the work station computer. However, there is also the option to transmit the data of the cleaners via a separate bus system to a separate computer in the central control device. Therefore the bus system of a textile machine with multiple stations must be designed to be able to transmit a multitude of data simultaneously without interruption. In an open-end spinning frame, for example, up to 300 spinning stations can be connected with the computer of the central control device via a common bus.

To assure interruption-free data transfer in both directions between the central computer and the respective work station computers and possibly also the yarn quality monitors, careful installation and connection of the bus lines and the connecting components is required, which is expensive. So that the correct association of the data with the individual work stations is possible, each work station is assigned a coded address which must be added during each data transmission to or from the work station, so that the data can be addressed to the correct work station or can be associated with the work station which has transmitted the data. Addressing and coding requires computer capacity and time. Data can be lost or erroneously associated because of coding errors. If coding is mechanically performed by means of a defined wiring design, the outlay for the installation is particularly great. In addition, because of the limited number of lines typically feasible, such coding is only usable for a considerable smaller number of work stations than are present in an open-end spinning frame, for example.

OBJECT AND SUMMARY OF THE INVENTION

It is accordingly a fundamental object of the instant invention to simplify the data exchange between the central control device and the individual work stations in a textile machine with a plurality of similar work stations.

This object is achieved in accordance with the present invention by providing a textile machine of the type having a plurality of identical work stations and a traveling service unit arranged to move along the work stations with an improved system for supplying control data to and deriving operational data from the work stations utilizing a central control device disposed on the traveling service unit and a plurality of local control devices each disposed at a respective one of the plural work stations. The central control device has data processing means, memory means for data storage, and a data input device and each of the local control devices similarly has data processing means and memory means for data storage. Means are also provided for individually connecting each of the local control devices with the central control device for data exchange therebetween when the traveling service unit is disposed at a respective work station. Essentially, the connecting means comprises a first data transmitting and receiving device disposed on the service unit and operatively connected with the central control device and a plurality of second data transmitting and receiving devices each disposed at a respective one of the work stations and operatively connected with the respective local control device thereof, the first and second data transmitting and receiving devices being compatible for transferring yarn and operational data between the central and local control devices.

In the preferred embodiment, each work station includes a yarn quality monitor connected with the local control device thereof for data exchange therewith, and the input device of the central control device comprises means for inputting control programs for the yarn quality monitors. The input device of the central control device is additionally equipped for inputting complete programs for controlling the work stations.

It is also preferred that the central control device of the service unit comprise means for storing predetermined standards for yarn characteristics and operational parameters at a work station, means for determining deviations in the data collected at a work station from the predetermined standards, and means for initiating corrective action at a work station at which deviations from a predetermined standard are determined. The data processing means of the central control device comprises means for assimilating data collected at the work stations and for outputting the assimilated data.

The advantages of the present invention lie in that the installation of an expensive data bus system between the central control device of the machine and the local control devices and possibly also between the yarn quality monitors and the individual work stations can be omitted. Additionally, the addressing of the data to be transmitted by means of a code, which must be decoded at the respective receiver of the data, is also omitted, which saves corresponding programs and computer capacities and decreases the computing outlay at the central control device. Outlay for material and assembly is also saved. In accordance with the invention, a data exchange always takes place when the traveling service device, with the central control device arranged on it, is positioned in front of a work station.

Furthermore, no separate control device is needed for the service device. The function to be exercised by this control device is executed, together with the control of the machine, by a common computer which is a part of the control device on the service device.

In the course of restarting a textile machine, for example following a batch change in an open-end spinning machine, the data relating to the work station, to the batch or the yarn quality is input into the central control device on the service device, e.g., a piecing carriage. The service device subsequently moves from spinning station to spinning station, where the data from the spinning station is read into the central control device and piecing takes place at respectively the same position.

It is also possible to transfer complete programs at the work stations. Since reading in a program as a rule requires a greater outlay in time and transmission capability than the transmission of data concerning a few events, a known bus system would be blocked from the exchange of other data while a program is being transmitted. Since the textile machine in accordance with the present invention does not have such a bus system, other work stations cannot be disturbed when a program is loaded at a work station.

The gathering, assimilation and compilation of collected data, for example with information regarding the quality of the yarn with reference to slubs and nips, etc., or regarding the efficiency of the machine based on yarn breaks, yarn splicings performed or stop motion circuits, can take place without a data bus. The event data, the production data and the yarn quality data are respectively stored in the computers of the control devices until such time that the service device has been positioned at a work station because of service work to be performed, for example for yarn piecing. At those times, the memory of the computer of the local control device can always be interrogated regarding the data, which can then be processed. The assimilated data can be prepared by the central control device and transmitted to a device for outputting data, for example in the form of a printout or on a data screen.

The invention will be explained in more detail hereinbelow by means of an exemplary embodiment.

DETAILED DESCRIPTION OF THE PREFERRED EMBODIMENT

Figure 1:
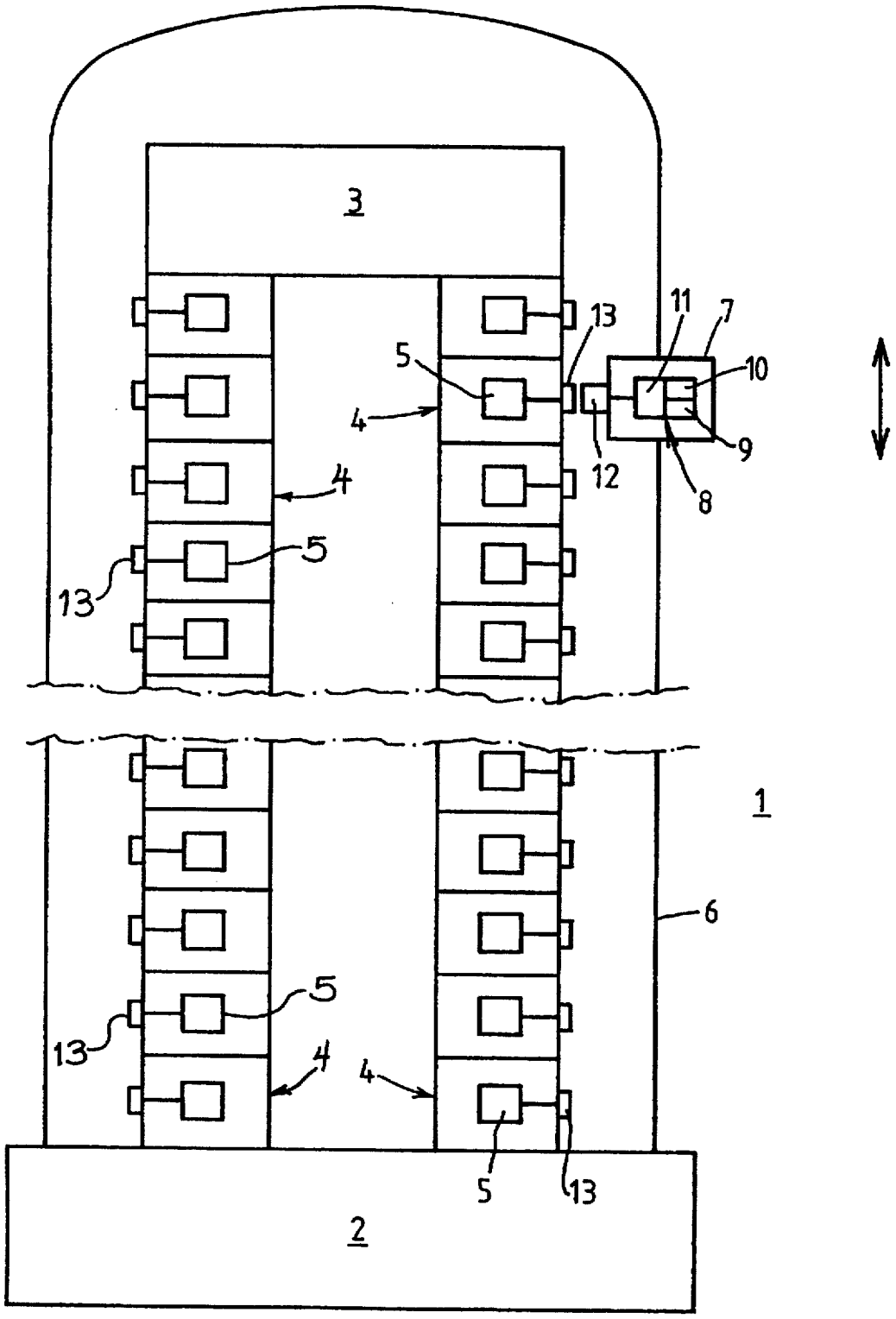
FIG. 1 is a schematic plan view of an open-end rotor spinning frame with a traveling service device movably disposed along the work stations and a central control device disposed on the service device.

Referring now to the accompanying drawings and initially to FIG. 1, a rotor spinning machine 1 is schematically shown in a top plan view wherein only the characteristics essential for a descriptive explanation of the invention are shown and described.

A plurality of spinning stations 4 are disposed side-by-side one another along the length of the rotor spinning frame 1 between a drive unit 2 at one end of the spinning frame, in which all of the drive units for operating the individual spinning stations and the associated winding apparatus are located, and an end unit 3 at the opposite end of the spinning frame, which contains a suction installation for generating a vacuum supply to all of the spinning stations. Each spinning station 4 contains its own respective local control device 5. A traveling service unit 7 moves along a rail 6 extending along the spinning stations 4 to travel from one spinning station to another. This service unit can be a yarn piecing carriage, for example, whose structure and purpose is known from the prior art, for example from German Patent Publications DE 38 01 965 Al or DE 43 13 523 Al.

Besides the normal on-board devices required for performing the service operations of the piecing carriage, the piecing carriage in the instant exemplary embodiment contains a central control device 8 with a data input device 9, e.g. for inputting data into the central control device relating to yarn batches, yarn quality and work stations, as well as a data output device 10 for outputting data, such as event data, production data and yarn quality data derived from the individual spinning stations, which can also be compiled or assimilated according to a predetermined program or into a desired format, for example over the length of a shift or a batch. Thus, the central control device 8 stores the data which has been input for transmission to the individual work stations and it also processes the data read from the individual work stations and prepares the appropriate assimilated data therefrom.

The service unit 7 as well as the individual spinning stations 4 are respectively equipped with data transfer devices 12 and 13 for such data exchange. Each time the service unit 7 is positioned in front of one of the spinning stations 4, an exchange of data between the central control device 8 and the local control device 5 at the spinning station 4 is possible via these devices 12 and 13. How these devices can be designed for data exchange and how they operate is shown and described by way of example in German Patent Publication DE 38 41 464 Al, which discloses appropriate devices for signaling, receiving signals and for carrying on a dialogue by means of bi-directional wireless data transmission. By means of these devices a contactless, bi-directional data transmission between the central control device 8 on the service unit 7 and a local control device 5 at any spinning station 4 is possible. Besides these known devices, a data exchange by optical or acoustical means is also conceivable. A mechanical data transfer connection is also conceivable, for example by means of wiper contacts in the area of the respective spinning station.

Figure 2:
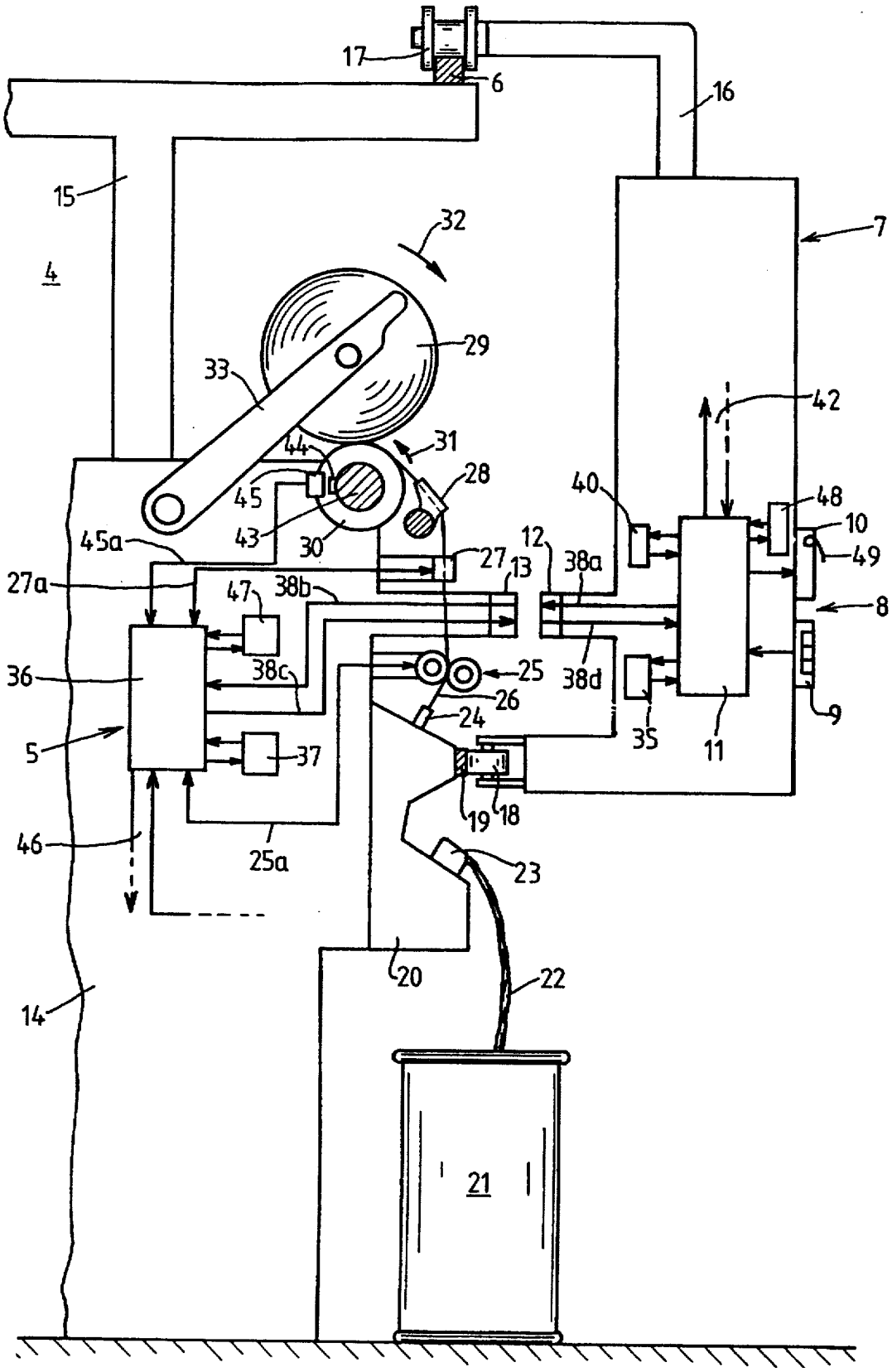
FIG. 2 is a side elevation taken at one work station of the spinning frame of FIG. 1 depicting a data exchange between the work station and the service device positioned thereat.

The situation prevailing during a data exchange between the central control device 8 on the service unit 7 and the local control device 5 of a spinning station 4 is represented in FIG. 2 which depicts the traveling service unit 7 positioned at a spinning station 4 of the rotor spinning frame, shown only schematically with its most important features.

The structural framework 14 of the spinning frame has a superstructure 15,with a longitudinal rail 6 on which the service unit 7 is seated for traveling movement therealong by means of a drive (not shown). A jib boom 16 is supported on the rail 6 by means of running and drive wheels, represented by one wheel 17 shown in FIG. 2, and carries the service unit 7 suspended from the opposite end of the boom 16. The service unit 7 is additionally supported and stabilized by means of another wheel 18 which laterally engages a longitudinal runner rail 19 extending along the machine on the so-called spin box 20 of each spinning station 4.

A yarn is spun in the known manner of open-end spinning in the spin box 20. Sliver 22 is drawn for this purpose into the spin box via a so-called condenser 23 out of a sliver storage can 21 located underneath the spin box 20. The yarn 26 spun in the spin box 20 from the sliver 22 is drawn out through a draw-off tube 24 by means of a pair of withdrawal rollers 25. The yarn quality is checked in a yarn quality monitor 27, commonly referred to as a so-called cleaner. In case of impermissible slubs or nips, as well as in case of moire effects, the yarn is cut in a cutting device integrated into the yarn quality monitor.

During the spinning operation, the yarn 26 is placed by a yarn guide 28 in cross wound layers on a carrier tube to form a yarn package commonly referred to as a cheese 29. The cheese 29 is supported by a spooling frame 33 pivotably disposed on the machine frame 14 to hold the circumferential yarn surface of the cheese 29 in contact with a driven winding roller 30 rotating in the direction of the arrow 31 for driving the cheese 29 in the opposite direction of the arrow 32.

As indicated, FIG. 2 shows the service unit 7 in a position in front of the spinning station 4. In this position, the service unit 7, for example a yarn piecing carriage additionally equipped with cleaning devices for the individual spinning units of the multiple spinning stations 4, can perform service work including, for example, the preventive cleaning of the rotors of the open-end spinning stations.

The aforementioned data input device 9 is indicated on the service unit 7 and can be a keyboard, for example, by means of which the pertinent control data relating to the desired operation of the work station, to the yarn batch to be spun, the yarn quality or other appropriate control parameters or instructions for operation of the spinning stations can be input into a computer or other processor or controller 11 of the central control device 8. The computer 11 initially stores such data in a memory location 35. To restart a spinning station, for example following a batch change, the data exchange devices, i.e., the device 12 on the service unit 7 and the device 13 at the spinning station 4, must be opposite each other. The devices 12 and 13 are equipped such that they can function as transmitters as well as receivers. To read the data required for the spinning operation into the local control device 5, the data is read out of the memory 35 and transferred by means of the device 12, operating in this mode as a transmitter, to the device 13, operating as a receiver in this mode, into a computer, processor or other controller 36 of the local control device 5, which then stores the data in a memory 37. In FIG. 2, this data transfer is symbolized by the arrows 38*a* on the service unit 7 and 38*b* at the spinning station 4.

Following the termination of the data input, any required service operation at the spinning station 4, e.g., the piecing-up of the yarn, and the subsequent start-up of the spinning station for the spinning operation, the service unit continues its traveling movement to the next spinning station in sequence to also transfer the data required for the spinning operation into the local control device thereat and to start the spinning process.

The performance of service work at the spinning stations 4 is also controlled by the central computer 11 on the service unit 7. Data relevant for the operation of the service unit 7 can be read into the computer 11 via the input device 9 and stored in a memory 40. For example, the control device 11 of the service unit 7 can transmit to the local control device 5 of the spinning station 4 a signal for opening the pair of draw-off rollers 25 to enable performance of a piecing operation. Based on the signal of the computer 11 of the control device 8 on the service unit 7, the control device 5 at the spinning station 4 will trigger a device via the signal line 25*a*, by means of which the pair of draw-off rollers 25 are opened. As representatively indicated by means of the two-headed arrow 42, the computer 11 has direct access to the various operational devices on the service unit 7. Thus, every time the service unit 7 is positioned in front of a spinning station 4 during the spinning operation to perform service work, it is possible for the central control device 8 of the service unit 7 to be connected with the local control device 5 of the spinning station 4 to initiate an interrogation of the event data, the production data and the yarn quality data (or any other relevant predetermined data) for that respective spinning station 4. This interrogation is symbolized in FIG. 2 by the arrows 38*c* and 38*d*. By means of this interrogation, the central control device 11 can determine, for example, whether deviations from a predetermined standard have occurred at a spinning station 4,such as deviations from data read in during the restart, which result in a reduction in the quality of the yarn. In such case, the computer 11 of the central control device 8 can autonomously intervene by presenting fresh data to the local control device 5 to remedy errors which have occurred, or to stop the respective spinning station, so that the error can be remedied by an operator.

The yarn quality data is determined by the yarn quality monitor 27, the so-called cleaner. Any detected quality deviations are reported via the signal line 27*a* to the computer 36 of the control device 5 at the spinning station 4. A signal emitter 44 is disposed on the drive shaft 43 of the winding roller 30 whereby the signals emitted per unit of time by the signal emitter 44 may be counted by means of a sensor 45 and in this manner the winding speed (rpm) of the winding roller 30 for this unit of time is determined. These signals are forwarded to the computer 36 of the control device 5 of the spinning station via the signal line 45*a*. It is possible by means of this data to determine the length of yarn spun, for example, which is part of the production data.

The two-headed arrow 46 at the control device 5 is intended to indicate that further data of the spinning station, for example data from the spin box 20, is transmitted to and stored by the local control device 5 and that it is also possible for the local control device 5 to issue commands, for example for controlling operational elements of the spin box 20, to disconnect the draw-in roller for a piecing operation and/or to lift the spinning rotor off its drive belt and brake it.

The data collected at a spinning station can be stored in a memory 47 of the spinning station computer 36, for example, and called up by the central control device 8 when the service unit 7 is positioned in front of the spinning station. The data can be reviewed at the output device 10 for obtaining information regarding the status of the work station, its yarn production or the yarn quality. To obtain an overview over longer periods of time, for example a shift, several days, or the running time of a batch, the computer 11 of the central control device 8 can be programmed to assimilate, compile or otherwise process data, which can relate to work stations, machines, batches, yarn quality or time, and to store such assimilated data in a memory 48 in order to be output by means of the output device 10 when called up, for example as a printout 49 on a strip of paper. Display on a screen would also be conceivable.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A textile machine having a plurality of identical machine work stations at which textile machine operations are performed, the textile machine comprising a traveling service unit arranged to move along the work stations and a system for supplying control data to and deriving operational data from the work stations, the data system comprising a central control device for controlling all work stations associated with the textile machine and having data processing means, a central memory for data storage unit associated with the textile machine, and a data input device, the central control device being disposed on the traveling service unit, a plurality of local control devices each being disposed at a respective one of the plural work stations and each having data processing means and memory means for data storage, and means for individually connecting each of the local control devices with the central control device for data exchange therebetween when the traveling service unit is disposed at a respective work station, the connecting means comprising a first data transmitting and receiving device disposed on the service unit and operatively connected with the central control device and a plurality of second data transmitting and receiving devices each disposed at a respective one of the work stations and operatively connected with the respective local control device thereof, the first and second data transmitting and receiving devices being compatible for transferring control and operational data between the central and local control devices.

2. A textile machine in accordance with claim 1,wherein each work station includes a yarn quality monitor connected with the local control device thereof for data exchange therewith, and that the input device of the central control device comprises means for inputting control programs for the yarn quality monitors.

3. A textile machine in accordance with claim 1, wherein the input device of the central control device is equipped for inputting complete programs for controlling the work stations.

4. A textile machine in accordance with claim 1, wherein the central control device of the service unit comprises means for storing predetermined standards for operational parameters at a work station, means for determining deviations in the data collected at a work station from the predetermined standards, and means for initiating corrective action at a work station at which deviations from a predetermined standard are determined.

5. A textile machine in accordance with claim 4, wherein the means for initiating corrective action comprises means for stopping the work station.

6. A textile machine in accordance with claim 1, wherein the central control device further comprises a device for outputting data derived from a work station.

7. A textile machine in accordance with claim 6, wherein the data processing means of the central control device comprises means for assimilating data collected at the work stations and for outputting the assimilated data.

* * * * *